US005577290A

United States Patent [19]

Monahan

[11] Patent Number: 5,577,290

[45] Date of Patent: Nov. 26, 1996

[54] WET MOP WITH SELF-CONTAINED WRINGER

[76] Inventor: Patrick H. Monahan, 239 S. Pine St., Arcola, Ill. 61910

[21] Appl. No.: 571,707

[22] Filed: Dec. 13, 1995

[51] Int. Cl.[6] ..... A47L 13/12; A47L 13/142

[52] U.S. Cl. ..... 15/120.1; 15/118; 15/229.2

[58] Field of Search ..... 15/116.1, 116.2, 15/118, 119.1, 119.2, 120.1, 120.2, 229.2

[56] References Cited

U.S. PATENT DOCUMENTS

| | | | |
|---|---|---|---|
| Re. 15,274 | 1/1922 | Kenner . | |
| 462,100 | 10/1891 | Mullen . | |
| 973,491 | 10/1910 | Fischer, Jr. . | |
| 1,426,440 | 8/1922 | Zieschang . | |
| 1,466,169 | 8/1923 | Hultquist . | |
| 1,514,051 | 11/1924 | Jumonville . | |
| 1,527,234 | 2/1925 | Swasey . | |
| 1,529,143 | 3/1925 | Pollard . | |
| 1,585,306 | 5/1926 | MacPherson . | |
| 1,700,136 | 1/1927 | Leidgen . | |
| 1,709,622 | 4/1929 | Justis . | |
| 1,710,190 | 4/1929 | Regan . | |
| 1,760,695 | 5/1930 | Hertzberg . | |
| 1,814,527 | 7/1931 | Potter, Jr. . | |
| 1,848,481 | 3/1932 | Hertzberg . | |
| 2,365,437 | 12/1944 | Schaefer . | |
| 2,482,163 | 9/1949 | Finnell | 15/118 |
| 2,495,846 | 1/1950 | Johnson . | |
| 3,072,943 | 1/1963 | Cone . | |
| 3,151,475 | 10/1964 | Johnson | 15/120.1 |
| 3,699,603 | 10/1972 | Popeil . | |
| 3,946,457 | 3/1976 | Robinson | 15/119.1 |
| 4,130,910 | 12/1978 | Raven . | |
| 4,178,650 | 12/1979 | Aasland . | |
| 4,464,807 | 8/1984 | Weiss . | |
| 4,479,278 | 10/1984 | Heinonen . | |
| 4,809,387 | 3/1989 | Nakamura et al. . | |
| 4,903,366 | 2/1990 | Traglia . | |
| 5,060,338 | 10/1991 | Yates et al. . | |

FOREIGN PATENT DOCUMENTS

| | | | |
|---|---|---|---|
| 122891 | 2/1919 | United Kingdom | 15/119.1 |

*Primary Examiner*—Mark Spisich
*Attorney, Agent, or Firm*—R. William Graham

[57] ABSTRACT

A mop has a self-contained wringer, a handle, a sleeve frictional movably disposed on the handle such that the sleeve is self supporting along a number of positions of the mop handle, a retainer member connected to an end of the handle and having a receiving surface, mop head material having one end connected to the sleeve and another end of the mop head material positionable adjacent the receiving surface of the retainer member, a resilient scrub pad material having an open surface defined therein disposed adjacent the another end of the mop head material and the receiving surface, and an insert having a portion configured to fit through the open surface of the scrub pad material and be connectably received into the receiving surface in a manner such that the insert and scrub pad material bind and lock the another end of the mop head material against the receiving surface.

17 Claims, 4 Drawing Sheets

WET MOP WITH SELF-CONTAINED WRINGER

BACKGROUND OF THE INVENTION

1. Field of the Invention

The present invention relates to mops. More particularly, the invention relates to a wet mop having a self-contained wringer and unique scrubbing element.

2. Related Art

There exist numerous types of mops in the art, such as twist mops, squeeze mops, wringer mops, etc. Each of these mops will include a handle, mop head material connected to the handle and means for removing water from the mop head material upon demand.

A problem associated with all of the prior mop designs is the way in which to connect the mop head material to the handle in a manner which maximizes the mop head material for mopping purposes yet permits the same to be readily rid of water upon demand. Additionally, in the case of self wringing type mops, there is lacking a sufficient means for connecting the mop head material to the handle in a manner to permit effective scrubbing power at the butt or end of the handle to where a part of the mop head material is typically connected. A part of the mop head material of the self wringing mop which is commonly connected to a fixing head is rotatable on the mop handle to effect a wringing of the mop head material. The problem with existing fixing heads is that they fail to be readily axially movable and positionable in a self supporting manner along the handle.

There remains a need therefore to provide an improved mop, particularly, a mop having a self-contained wringer with improved scrubbing ability, positionability and wringability of the mop head material.

SUMMARY OF THE INVENTION

It is an object of the present invention to improve mops.

It is another object of the present invention to improve self contained wringing mops.

It is a further object to improve the scrubbing capability of a mop with a self-contained wringer.

Accordingly, the present invention is directed to a mop having a self-contained wringer, a handle, a sleeve frictionally movably disposed on the handle such that the sleeve is self supporting along a number of positions of the mop handle, a retainer member connected to an end of the handle and having a receiving surface, a mop head material having one end connected to the sleeve and another end of the mop head material positionable adjacent the receiving surface of the retainer member and an insert having a portion configured be connectably received into the receiving surface in a manner such that the insert binds and locks the another end of the mop head material against the receiving surface. Also, included in the mop is a resilient scrub pad material having an open surface defined therein such that the insert portion passes therethrough and the pad is disposed adjacent and between the another end of the mop head material and the insert.

The insert is further defined such that upon connection to the retainer member, it is substantially recessed below a surrounding outer surface of the scrub pad material in a manner such that it does not substantially affect the scrub pad's ability to effectively scrub a surface. The sleeve is formed with a raised gripping surface portion and inner biasing member which imparts an ability of the sleeve to be readily moved upon user overcoming the frictional force of the biasing member yet assuredly maintains the sleeve's position once positioned for purposes of mopping.

Other objects and advantages will be readily apparent to those skilled in the art upon viewing the drawings and reading the detailed description hereafter.

DETAILED DESCRIPTION OF THE PREFERRED EMBODIMENTS

Figure 1:
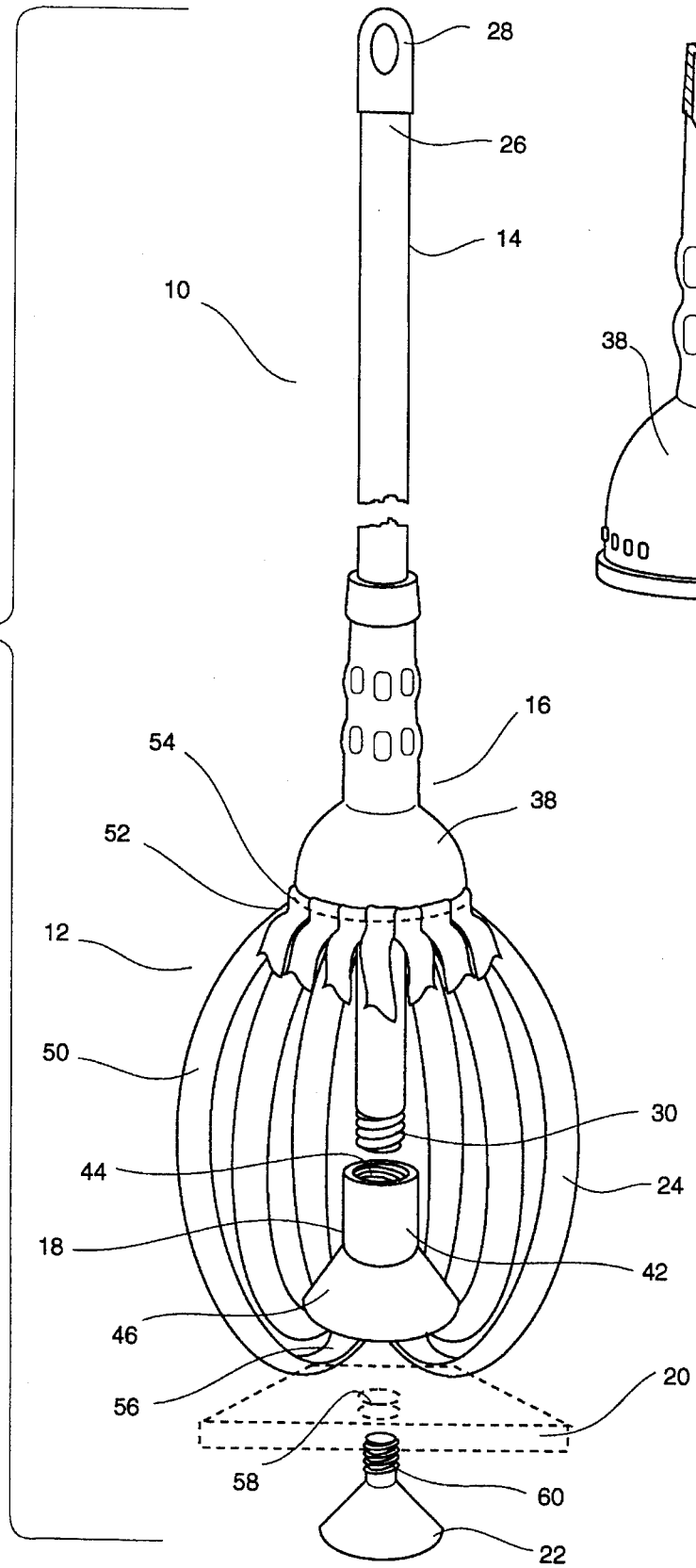
FIG. 1 is an elongated perspective view of the mop having a self container wringer of the present invention.

Referring now to the drawings, the present invention relates the wet mop 10 having a self-contained wringer 12. The mop 10 includes an elongated handle 14, a sleeve 16, retainer member 18, resilient scrub pad material 20, insert 22 and mop head material 24.

The handle 14 includes an end 26 having an eyelet cap 28 connected thereto to permit the mop 10 to be hung when not in use. The handle 14 has another end 30 formed with a threaded surface for a use which will be apparent hereinafter.

Figure 3:
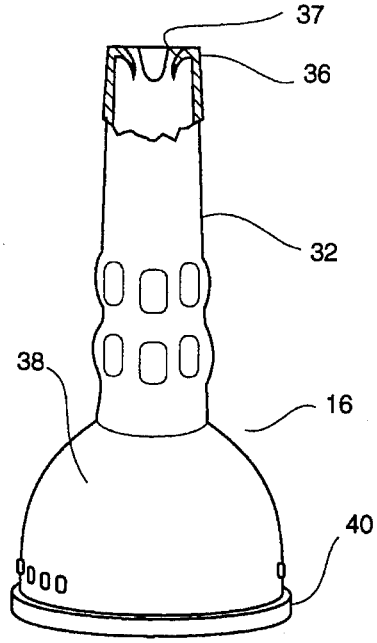
FIG. 3 is a partial sectional view of a part of the mop of the present invention.
Figure 2:
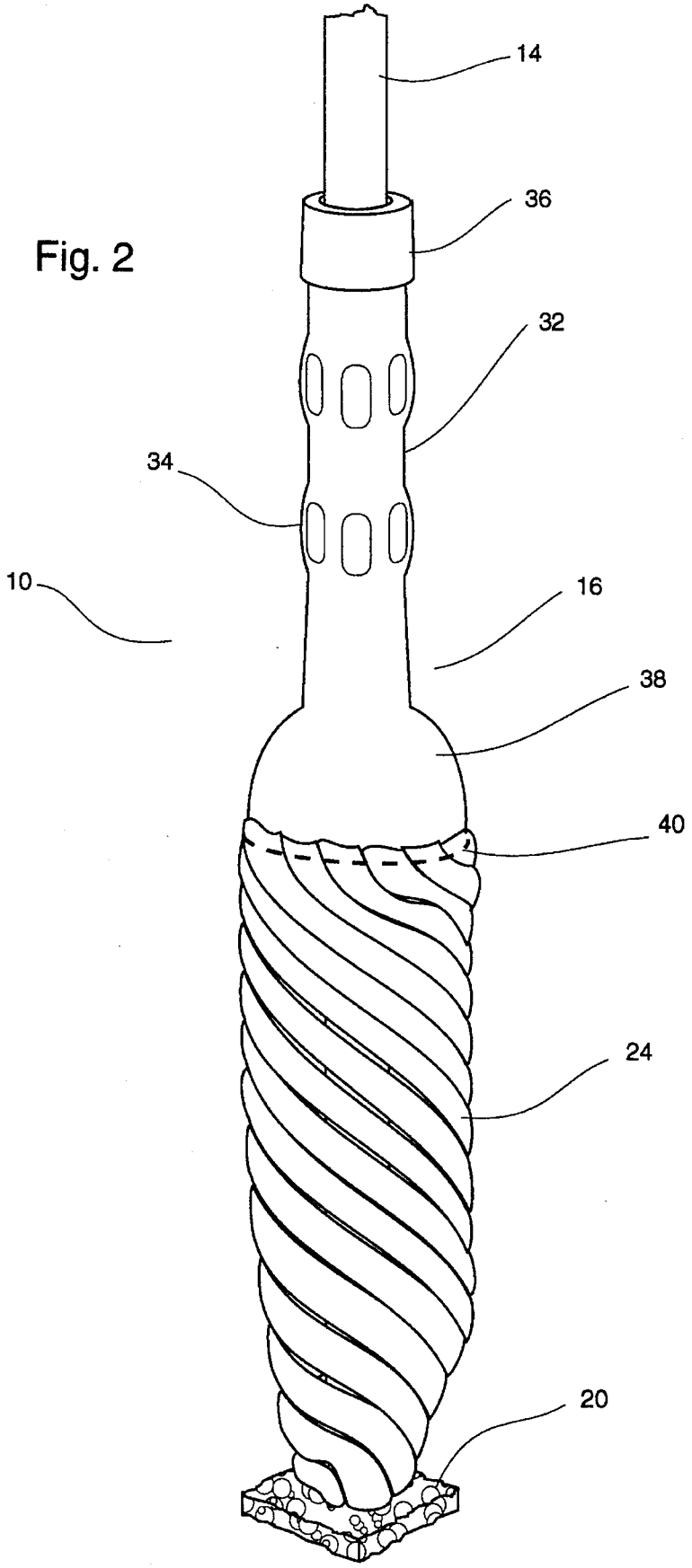
FIG. 2 is a side view of part of the mop having a self container wringer of the present invention.

The sleeve 16 has an elongated section 32 with radially bulging gripping surfaces portions 34 formed thereon. At one end 36, as best seen in FIG. 3, there is formed an inwardly extending biasing fingers 37 which permits the sleeve 16 to be frictionally movably disposed on the handle 14 such that the sleeve 16 is self supporting along a number of positions of the mop handle 14. Another end 38 of the sleeve 16 is hemibulbous shaped terminating in a lip portion 40.

The retainer member 18 has an end 42 which is formed with an open surface 44 which includes a portion threaded in a complimentary manner to receive the threaded end 30 of the handle 14. Another end 46 is generally frustoconical shaped with a receiving surface 47 and has at a center an open surface 48 which is threaded and extends partially into the retainer member 18.

The mop head material 24 includes a series of strips of absorbent and durable material as is known in the art, such as woven or unwoven natural or synthetic materials. For example, the materials may be made of plastic, such as polyester, polyurethane or polyether, or of natural, such as cotton, for example. As shown in the present invention, but not to be limiting, the mop head material 24 is formed with a series of generally parallel cuts to create individual intermediate strips 50 which are joined at their respective ends 52 and reinforced by stitching them to form a ring 54 of a diameter less than the diameter about the sleeve 16 at its terminating lip 40. The ring 54 can be worked into positioned such that the ring 54 is disposed onto the end 38 of the sleeve 16 wherein the lip 40 acts to retain the ring 54 from being pulled over the lip 40. The other ends 56 of the strips 50 are connected to one another and positioned adjacent the receiving surface 47 of the retainer member.

Figure 5:
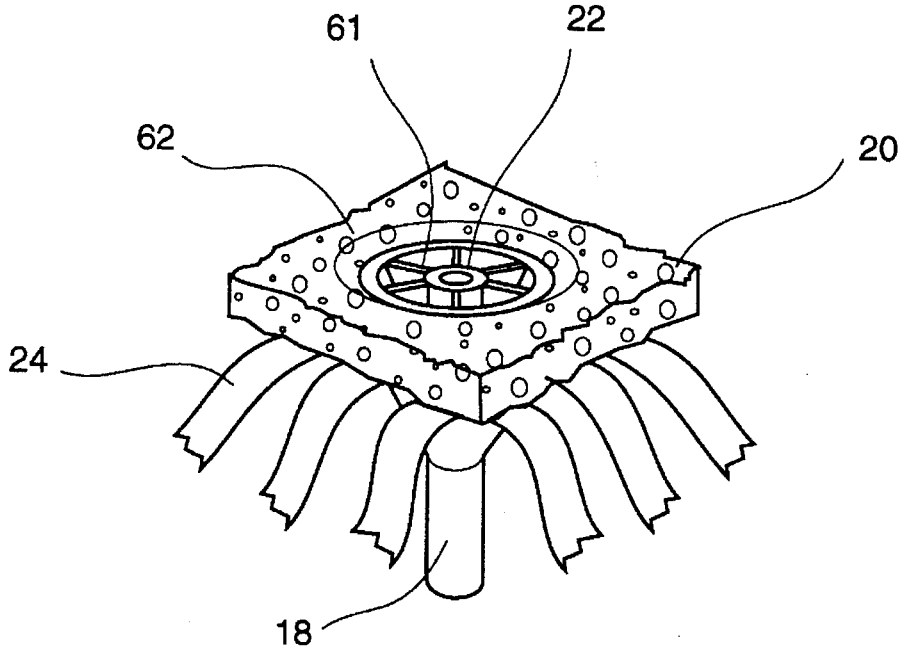
FIG. 5 is a partial perspective view of a part of the present invention.
Figure 4:
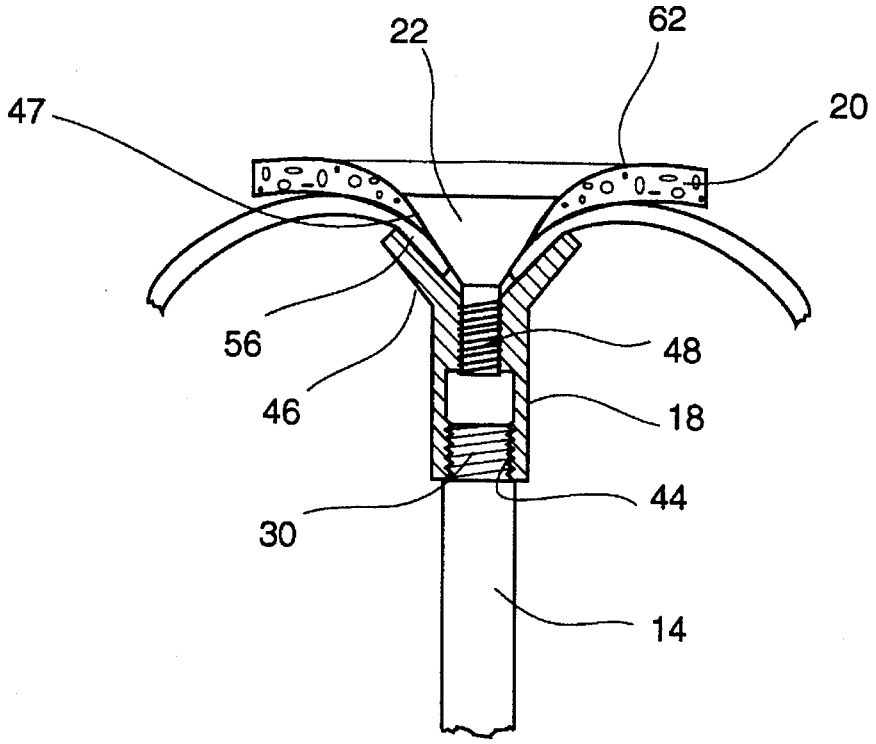
FIG. 4 is a partial sectional view of another part of the mop of the present invention.

The resilient scrub pad material 20 may be made of any suitable durable scrubbing material and preferably of relatively semi-flexible type plastic, such as those previously mentioned but formed in a manner to accomplish this purpose. In one embodiment as shown in FIGS. 4 and 5, the pad material 20 has an open surface 58 defined therein and is disposed adjacent ends 56 of the mop head material 24 and the receiving surface 47.

The insert 22 has a stem portion 60 which is threadably configured of a size to fit through the open surface 58 of the scrub pad material 20 and be threadably connectably received into the threaded surface 48 in a manner such that the insert 22 and scrub pad material 20 bind and lock the ends 56 of the mop head material 24 against the receiving surface 47. The insert 22 also has a gripping portion 61 to readily enable threaded connection of the insert 22 to the retainer member 18.

When the insert 22 is connected to the retainer member 18, it is substantially recessed below surrounding adjacent outer surface 62 of the scrub pad material 20 in a manner such that the insert 22 does not substantially affect the scrub pad material's ability to effectively scrub a surface.

Figure 8:
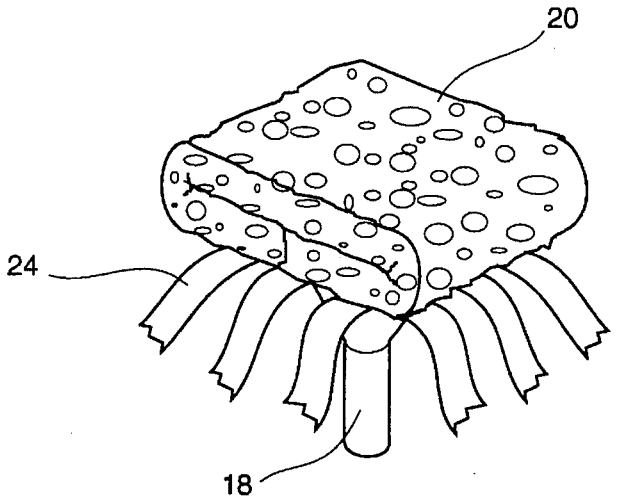
FIG. 8 is a partial perspective view of a part of another embodiment of the present invention.
Figure 7:
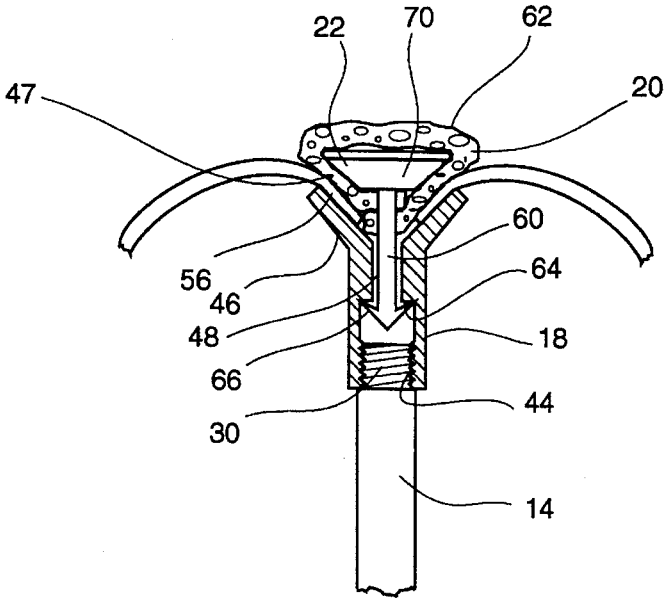
FIG. 7 is a partial sectional view of another embodiment part of the mop of the present invention.
Figure 6:
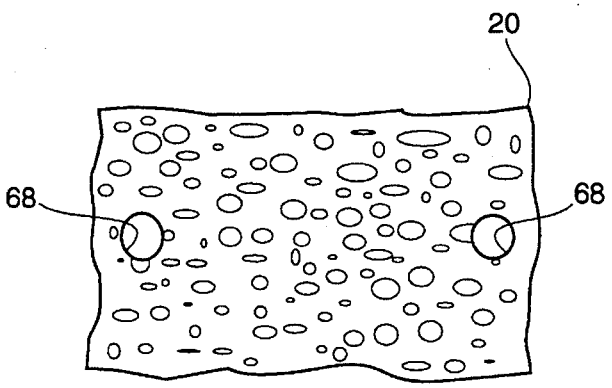
FIG. 6 is top view of a scrub pad as part of the present invention.

In another embodiment as shown in FIGS. 6–8, the retainer member 18 is formed substantially as described above with the exception that there need be no threaded aspect to the surface 48. Rather, a ledge or seat 64 formed between the open surfaces 44 and 48 is used to aid in retaining the insert 22. In this regard, the insert 22 need not include a threaded aspect, but includes a semi-flexible retaining head 66 of a larger diameter than the diameter of open surface 48 and capable of being temporarily disfigured and forcibly driven through the open surface 48 where upon reaching open surface 44, the head 66 reconfigures to its original shape adjacent the seat 64 to lock the insert 22 to the retainer member 18.

Here, the scrub pad material 20 is shown as being formed with a pair of open surfaces 68. Prior to insertion of the insert 22, the head 66 of the insert 22 is placed through one of the open surfaces 68 such that the open surface 68 is disposed about the stem portion 60. The scrub pad material 20 is wrapped over an end 70 of the insert and the remaining open surface 68 placed over the head 66 and onto the stem portion 60 to substantially envelop the end 70 and retain the scrub pad material 20 on the insert 22. Thus, when the insert 22 is inserted in the retainer member 18, the mop head material 24 is retained between the scrub pad material 20 and receiving surface 47 similarly as described above. It is noted that the embodiments of the scrub pad material 20 may be interchanged with the embodiments described for the insert 22 and retainer member 18.

By so providing the structure of the mop described herein, the present invention results in a new and improved mop having a self-contained wringer which is relatively simplistic to manufacture and durable. Moreover, the butt end of the mop now becomes a useful scrubbing tool capable of scrubbing surfaces which require more force to effectively clean the surface thereof. In addition, the sleeve provides the multipurpose of being relatively easily rotated on the handle to effectively wring the mop head material and subsequently positioned adjacent the retainer member in a self supporting fashion and with sufficient force to maintain the mop head material in a bunched fashion during the mopping process. Also, the design of the present invention lends itself to quick and easy replacement of one or both of the mop head material and scrub pad material.

The above described embodiments are set forth by way of example and are not for the purpose of limiting the present invention. It will be readily apparent to those skilled in the art that obvious modifications and variations can be made to the embodiments without departing from the scope of the invention. Accordingly, the claims appended hereto should be read in their full scope including any such modifications and variations.

What is claimed is:

1. A mop having a self-contained wringer; comprising:

a handle;

a sleeve frictionally movably disposed on said handle such that said sleeve is self supporting along a number of positions of the mop handle;

a retainer member connected to an end of said handle and having a receiving surface;

a mop head material having one end connected to said sleeve and another end of said mop head material positionable adjacent said receiving surface of said retainer member;

a resilient scrub pad material having an open surface defined therein disposed adjacent said another end of said mop head material and said receiving surface; and an insert having an end and a stem portion connected thereto, said stem portion configured to fit through said open surface of said scrub pad material and be connectably received into said receiving surface in a manner such that said end of said insert and said scrub pad material bind and lock said another end of said mop head material against said receiving surface.

2. The mop of claim 1, wherein said sleeve is formed with an inner biasing finger which imparts an ability to said sleeve to be readily moved along said handle upon a user overcoming a frictional force of said biasing finger while assuredly maintaining position of said sleeve once positioned on said handle for purposes of mopping.

3. The mop of claim 1, wherein said sleeve is formed with a radially bulging gripping surface portion.

4. The mop of claim 1, wherein said insert is further defined such that upon connection to said retainer member, said insert is substantially recessed below a surrounding outer surface of said scrub pad material in a manner such that said insert does not substantially affect said scrub pad material's ability to effectively scrub a surface.

5. The mop of claim 1, wherein said retainer member has a threaded receiving surface and said stem portion has a threaded surface complimentary to said retainer member threaded receiving surface.

6. The mop of claim 5, wherein said insert has a gripping portion to readily enable the threaded connection of said insert to said retainer member.

7. The mop of claim 1, wherein said retainer member has a first open surface at one end thereof which extends partially into said retainer member and a second open surface of a larger diameter than said first open surface of said retainer member which extends into said retainer to said first open surface such that there is a seat formed therebetween and said stem portion is of a diameter less than said diameter of said first open surface of said retainer member and said insert has a semi-flexible head formed on said stem portion of a diameter slightly larger than said diameter of said first open surface of said retainer member such that when said head is forcibly placed through said first open surface of said retainer member, said head upon reaching said second open surface configures against said seat to lock said insert to said retainer member.

8. The mop of claim 1, wherein said scrub pad material has a pair of open surfaces and wherein said open surfaces are disposed on said stem portion in a manner such that said scrub pad material envelopes said end of said insert.

9. The mop of claim 1, wherein said mop head material is further defined to be readily removably connectable to said sleeve and said retainer member.

10. A mop having a self-contained wringer; comprising:

a handle;

a sleeve frictionally movably disposed on said handle such that said sleeve is self supporting along a number of positions of the mop handle and wherein said sleeve is formed with an inner biasing member which imparts an ability to said sleeve to be readily moved along said handle upon a user overcoming a frictional force of said biasing member while assuredly maintaining position of said sleeve once positioned on said handle for purposes of mopping;

a retainer member connected to an end of said handle and having a receiving surface;

a mop head material having one end connected to said sleeve and another end of said mop head material positionable adjacent said receiving surface of said retainer member; and an insert having an end and a stem portion, said stem portion configured to be connectably received into said receiving surface in a manner such that said insert binds and locks said another end of said mop head material against said receiving surface.

11. The mop of claim 10, which further includes a resilient scrub pad material having an open surface defined therein such that said stem portion of said insert passes therethrough and said scrub pad material is disposed adjacent and between said another end of said mop head material and said insert.

12. The mop of claim 11, wherein said insert is further defined such that upon connection to said retainer member, said insert is substantially recessed below a surrounding outer surface of said scrub pad material in a manner such that said insert does not substantially affect said scrub pad material's ability to effectively scrub a surface.

13. The mop of claim 11, wherein said scrub pad material has a pair of open surfaces and wherein said open surfaces are disposed on said stem portion in a manner such that said scrub pad material envelopes said end of said insert.

14. The mop of claim 10, wherein said retainer member has a threaded receiving surface and said stem portion has a threaded surface complimentary to said retainer member threaded receiving surface.

15. The mop of claim 14, wherein said insert has a gripping portion to readily enable the threaded connection of said insert to said retainer member.

16. The mop of claim 10, wherein said mop head material is further defined to be readily removably connectable to said sleeve and said retainer member.

17. The mop of claim 10, wherein said retainer member has a first open surface at one end thereof which extends partially into said retainer member and a second open surface of a larger diameter than said first open surface of said retainer member which extends into said retainer to said first open surface such that there is a seat formed therebetween and said stem portion is of a diameter less than said diameter of said first open surface of said retainer member and said insert has a semi-flexible head formed on said stem portion of a size slightly larger than said diameter of said first open surface of said retainer member such that when said head is forcibly placed through said first open surface of said retainer member, said head upon reaching said second open surface configures against said seat to lock said insert to said retainer member.

* * * * *